United States Patent [19]

Garver

[11] 4,247,103

[45] Jan. 27, 1981

[54] TENNIS RACKET

[76] Inventor: John P. Garver, 9450 Sharrott Rd., Poland, Ohio 44514

[21] Appl. No.: 26,810

[22] Filed: Apr. 4, 1979

Related U.S. Application Data

[63] Continuation-in-part of Ser. No. 886,296, Mar. 13, 1978, Pat. No. 4,189,101.

[51] Int. Cl.[3] ..... A63B 49/02

[52] U.S. Cl. ..... 273/73 G

[58] Field of Search ..... 273/73 R, 73 C, 73 D, 273/73 E, 73 G, 73 H

[56] References Cited

U.S. PATENT DOCUMENTS

| | | | |
|---|---|---|---|
| 1,684,449 | 9/1928 | Kleinman | 273/73 E |
| 1,869,038 | 7/1932 | Allen | 273/73 H |
| 3,612,526 | 10/1971 | Brull | 273/73 G X |
| 3,702,701 | 11/1972 | Vaughn et al. | 273/73 H |
| 3,814,423 | 6/1974 | Shockley et al. | 273/73 C |
| 3,908,995 | 9/1975 | Portz | 273/73 G |
| 3,912,268 | 10/1975 | Robinson | 273/73 H |

FOREIGN PATENT DOCUMENTS

| | | | |
|---|---|---|---|
| 736167 | 9/1932 | France | 273/73 G |
| 12753 | of 1886 | United Kingdom | 273/73 E |
| 212195 | 3/1924 | United Kingdom | 273/73 G |

*Primary Examiner*—Richard J. Apley
*Attorney, Agent, or Firm*—Webster B. Harpman

[57] ABSTRACT

A tennis racket construction comprising a frame having an ovaloid head portion terminating in a pair of closely spaced parallel extensions which are adapted to receive a handle with the head portion of the frame being defined by the oppositely curving portions of the frame. A flexible metal throat is positioned between the oppositely curving portions of the frame to complete the ovaloid shape of the head of the racket and to provide the sole support for adjoining strings attached thereto.

8 Claims, 3 Drawing Figures

TENNIS RACKET

This is a continuation in part of application Ser. No. 886,296, filed Mar. 13, 1978 now U.S. Pat. No. 4,189,101.

BACKGROUND OF THE INVENTION (1) Field of the Invention:

This invention relates to tennis rackets of the type having metal frames such as those formed of aluminum extrusions and throat portions positioned between adjacent portions thereof to complete the typical oval shape of the head.

(2) Description of the Prior Art:

Prior rackets of this type may be seen in U.S. Pat. Nos. 3,702,701, 3,814,423 and 3,912,268.

In U.S. Pat. No. 3,702,701 a plastic throat takes the form of a member having a transverse arcuate curve in its area to which the strings are attached, elongated oppositely curved side portions which engage substantial areas of the metal frame and a deep centrally disposed cutaway area therebetween to form a relatively rigid structure.

The present invention discloses a throat with an arcuate curving member adjacent the strings, pivotally secured at its ends to a pair of oppositely disposed curving U-shaped support brackets affixed to the portions of the metal frame so as to form a flexible yet strong throat in the tennis racket.

U.S. Pat. No. 3,814,423 discloses a plastic throat wherein the cutaway area between the oppositely curving ends is transversely straight so that the arcuate curve of the end of the part adjoining the strings forms an area of smallest thickness in the throat midway between the oppositely disposed curving sides thereof.

In the present invention the throat is so formed as to define two oppositely disposed support brackets with an arcuate curving member pivotally secured therebetween.

U.S. Pat. No. 3,912,268 discloses a plastic throat in a tennis racket with its upper and lower areas defining oppositely disposed transverse curves so that the thinnest cross sectional area of the throat is midway between the sides thereof where it joins the metal frame of the racket.

In the present invention a flexible metal throat comprises an arcuate curving member pivotally secured at its ends to oppositely disposed metal support brackets affixed to the curved portions of the frame so as to provide a greater degree of flexibility to the head of the racket.

SUMMARY OF THE INVENTION

An improved tennis racket having a metal frame and a flexible metal throat wherein the throat is an arcuate curving member having its opposite ends pivotally secured to oppositely disposed support brackets on either side of the frame. The configuration of the flexible metal throat is such that the pivotally secured curving member can move relative to the support brackets and the frame providing a large degree of flexibility with the result that the frame can flex and acquire an increased and valuable resiliency characteristic which is useful in driving and controlling a ball engaged by the tennis racket.

DESCRIPTION OF THE PREFERRED EMBODIMENT

Figure 1:
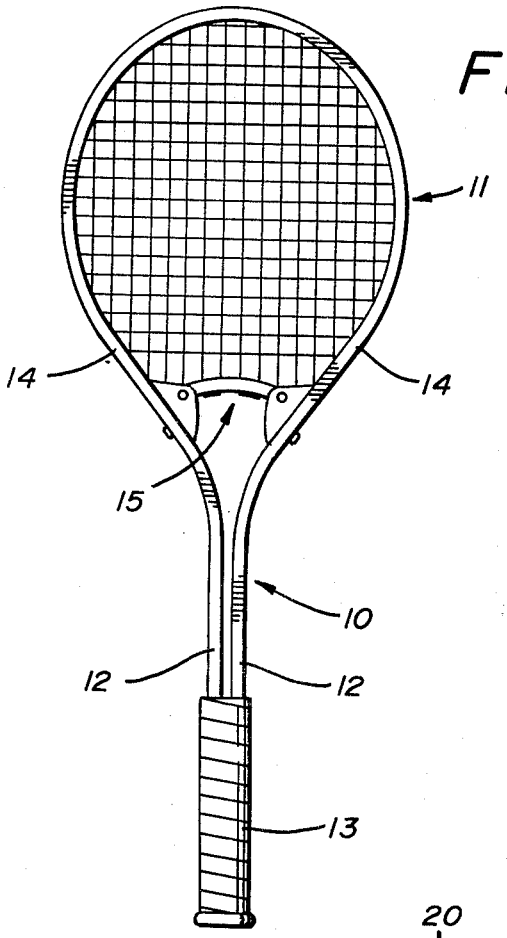
FIG. 1 is a plan view of the tennis racket incorporating the improved throat.

By referring to the drawings and FIG. 1 in particular, it will be seen that in the form of the invention chosen for illustration and description herein, the racket comprises a frame 10 having an approximately oval shaped or ovaloid head portion 11 terminating in a pair of closely spaced parallel extensions 12 which are held in position by a handle 13 which may be molded plastic and is preferably covered with a resilient continuous wrapping as seen in FIG. 1 of the drawings.

Figure 2:
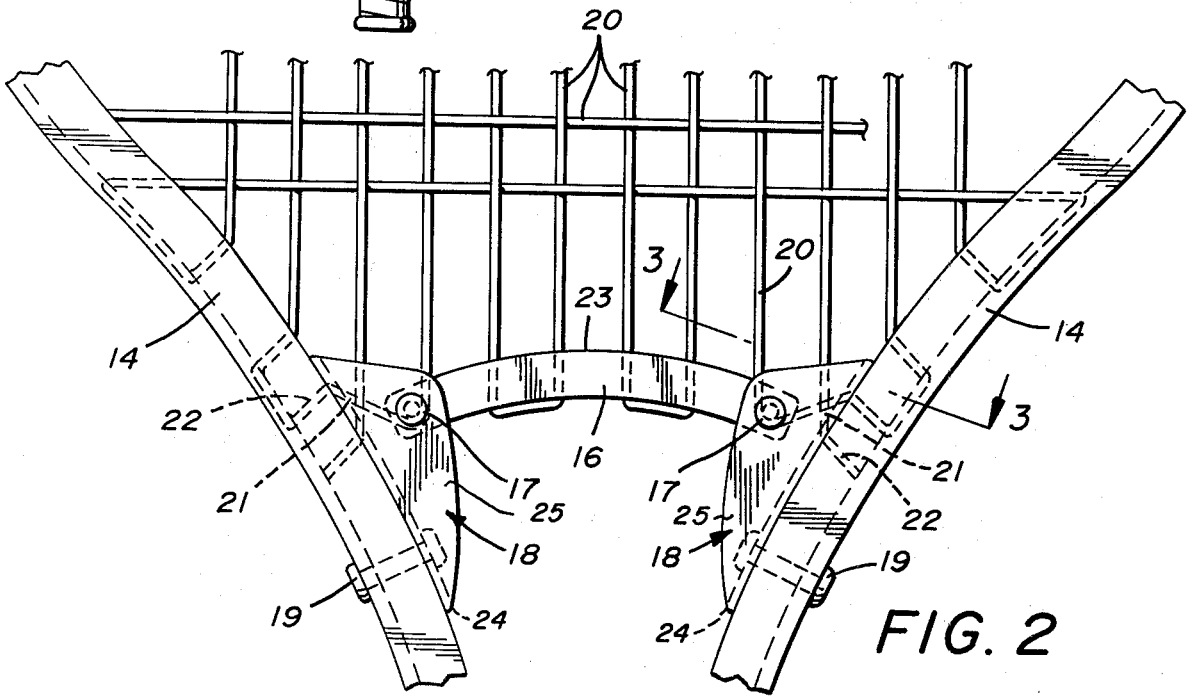
FIG. 2 is an enlarged plan view of a portion of the racket seen in FIG. 1.

The ovaloid head portion 11 is defined by a pair of oppositely disposed curved portions 14 of the frame 10, the parallel extensions 12 and the curved portions 14 thereof are preferably formed of a continuous metal channel shape such as an aluminum extrusion. The ovaloid shape of the head portion 11 of the tennis racket is completed by a throad 15 which is preferably made of metal and as best seen in FIG. 2 of the drawings is comprised of an arcuate curving member 16 pivotally secured at its ends by a pair of pivots 17 to a pair of oppositely disposed U-shaped support brackets 18 positioned on the lower sections of the oppositely curved portions 14 by fasteners 19. The throat 15 is additionally secured to the lower sections of the curved portions 14 of the tennis racket by engagement of the strings 20, some of which are positioned through drilled openings 21 in the oppositely disposed support brackets 18 so as to register with openings 22 in the oppositely curving portions 14 of the frame 10.

Still referring to FIG. 2 of the drawings, it will be seen that the arcuate curving member 16 is formed so that its upper surface 23 defines an elongated convex curve extending between the oppositely disposed support brackets 18.

Figure 3:
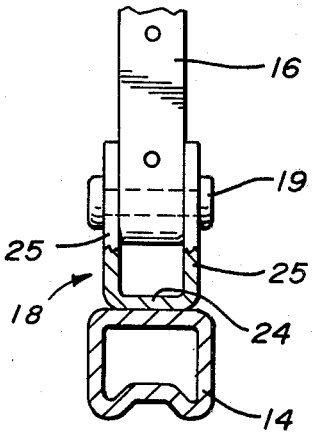
FIG. 3 is a cross section on lines 3—3 of FIG. 2.

As seen in FIG. 3 of the drawings, the oppositely disposed support brackets 18 each have a base 24 and a pair of spaced right angular flanges 25 forming a U-shaped channel. The base 24 of each of the support brackets 18 is curved longitudinally to conform with the curved portions 14 of the frame 10.

The structure just described and in particular the configuration of the throat 15 results in a firm yet flexible joining of the lower sections of the curved portions 14 of the frame 10 while at the same time providing a strong structural member to which the strings 20 of the racket may be secured and held in desired tensioned relation.

The unique configuration of the throat 15 and in particular the pivotally secured arcuate curving member 16 thereof which moves in relation to said U-shaped support brackets 18 allows the lower sections of the oppositely curved portions 14 of the head of the racket to move with respect to one another and this results in a novel resiliency in the racket which extends into the parallel extensions 12 of the frame 10. The resiliency and flexibility of the racket formed in accordance with this invention contributes greatly to the control of the tennis ball and the imparting thereto of a desired directional flight and force resulting in controlled travel thereof.

Although but one embodiment of the present invention has been illustrated and described, it will be apparent to those skilled in the art that various changes and modifications may be made therein without departing from the spirit of the invention, and having thus described my invention what I claim is:

1. A tennis racket comprising a frame having an ovaloid head portion terminating in a pair of closely spaced parallel extensions, said head portion being defined by a pair of oppositely curving portions of said frame, a pair of oppositely disposed support brackets on said oppositely curving portions of said frame and a throat positioned between said oppositely disposed supporting bracket and means pivotally securing said throat thereto, said oppositely disposed support brackets and said throat providing support for adjoining stringing extending thereacross, said throat comprising a single arcuately curved member, means affixing said support brackets to said oppositely curving portions of said frame so that said throat is flexibly positioned therebetween.

2. The tennis racket set forth in claim 1 and wherein said frame is a continuous metal channel and said single curved member and support brackets are metal.

3. The tennis racket set forth in claim 1 and wherein said frame is a continuous channel shaped aluminum extrusion and the support brackets are curved longitudinally to conform therewith.

4. The tennis racket set forth in claim 1 and wherein said single arcuately curved member has the surface thereof adjoining said stringing defining an elongated convex curve throughout its length.

5. The tennis racket set forth in claim 1 and wherein the means securing said support brackets to said oppositely curving portions of the frame comprises fasteners and portions of said stringing engaged in registering openings in the support brackets and said oppositely curving portions of the frame.

6. The tennis racket set forth in claim 1 and wherein said single arcuately curved member is of uniform cross section throughout its length.

7. The tennis racket set forth in claim 1 and wherein said single arcuately curved member is of cross sectionally square configuration throughout its length.

8. The tennis racket set forth in claim 1 and wherein said single arcuately curved member defines a radius substantially the same as the uppermost portion of said ovaloid head portion of said frame so that the stringing extending between said arcuately curved member and said uppermost portion of the ovaloid head is of substantially uniform length.

* * * * *